US007137569B1

(12) United States Patent
Miller et al.

(10) Patent No.: US 7,137,569 B1
(45) Date of Patent: Nov. 21, 2006

(54) CHEMICAL INJECTOR

(75) Inventors: R. Darrell Miller, Sand Springs, OK (US); Paul M. Magusin, Tulsa, OK (US)

(73) Assignee: Kenco International, Inc., Tulsa, OK (US)

( * ) Notice: Subject to any disclaimer, the term of this patent is extended or adjusted under 35 U.S.C. 154(b) by 0 days.

(21) Appl. No.: 10/907,549

(22) Filed: Apr. 5, 2005

(51) Int. Cl.
*B05B 1/00* (2006.01)
*B05B 7/04* (2006.01)
*B05B 7/08* (2006.01)
*B05B 7/00* (2006.01)

(52) U.S. Cl. ..... 239/8; 239/599; 239/426; 239/434

(58) Field of Classification Search ..... 239/599, 239/8, 426, 434, 10, 271, 272, 418, 429, 239/433, 589, 592–594, 597, 598; 137/896; 166/90.1, 305.1; 210/198.1, 199; 261/78.1, 261/78.2, 76, 115, 118
See application file for complete search history.

(56) References Cited

U.S. PATENT DOCUMENTS 1,243,892 A * 10/1917 Strong ..... 406/108
3,012,676 A * 12/1961 Englesberg ..... 210/94
3,606,166 A * 9/1971 Whear ..... 239/272
3,734,111 A 5/1973 McClintock ..... 137/3
4,995,915 A 2/1991 Sewell et al. ..... 134/22.14
5,277,250 A 1/1994 Dela ..... 166/90
5,993,296 A 11/1999 Rogers ..... 451/49
6,165,372 A 12/2000 Ziemer et al. ..... 210/749
6,238,557 B1 5/2001 Ziemer et al. ..... 210/198.1

* cited by examiner

*Primary Examiner*—Justine R. Yu
*Assistant Examiner*—Darren Gorman
(74) *Attorney, Agent, or Firm*—Head, Johnson & Kachigian

(57) ABSTRACT

A chemical injector for injecting fluid chemical into a pipeline having an axis wherein the pipeline has fluid flow moving from an upstream to a downstream direction. The chemical injector includes an injector tube having an axis substantially perpendicular to the axis of the pipeline. An injector tube tip extends from the injector tube having an angled end, wherein the angled end forms a line extending from the injector tube axis toward the downstream direction at an acute angle. A circular aperture through the tube tip angled end of the injector tube assists in dispersing the fluid chemical in the pipeline.

15 Claims, 1 Drawing Sheet

CHEMICAL INJECTOR

BACKGROUND OF THE INVENTION

1. Field of the Invention

The present invention relates to a chemical injector for injecting a fluid chemical into a liquid or gas pipeline. In particular, the present invention is directed to a method and apparatus for a pipeline chemical injector which will promote atomization and dispersion of the injected fluid chemical in a manner superior to existing processes and devices.

2. Prior Art

Various industries utilize processes and devices wherein a liquid chemical is injected into a pipeline hauling a moving fluid stream. These industries include natural gas transmission and distribution, oil and gas production and gathering, petrochemical processing and refining, water conditioning and treating, and various types of chemical processing. By way of example, mercaptan may be injected into a natural gas pipeline as an odorant. Other examples of fluid chemicals injected into pipelines include corrosion inhibitors, paraffin inhibitors, and scale inhibitors.

Existing devices for injecting chemicals suffer from four basic drawbacks. The present invention seeks to address these concerns.

First, they are relatively complicated devices that require substantial modification to the pipeline with the concomitant expenditure for materials and labor. Once such devices are installed, they must remain in place. The optimum location for the injector depends on the chemical process. As the process changes, or as new process equipment is installed in or around the pipeline, the optimum location can change. Thus, it is beneficial for the injector to be easily removed and relocated.

A second drawback is pressure drop. The ability for a pipeline to carry fluid from one point to another is directly related to the addition of pumping pressure to the fluid. The energy cost of running a pump is the overhead cost of pipeline operation. Thus, any device within the pipeline that causes the loss of pressure results in a lowering of pipeline capacity and the subsequent loss in revenue. Thus, it is a great benefit for the chemical injector to minimize pressure loss. Many devices require substantial impingement of the area of the pipeline cross section. Such impingements result in pressure drop across the device and the resulting loss in flow capacity.

The third problem is fouling of the injector. In order to effectively atomize the injection fluid, a common means is by forcing the injected fluid through small ports in the injection tip. Experience shows that the viscosity of the injection fluid, along with long-term build-up of fine impurities in the injection fluid, results in the eventual fouling of the ports in the injection tip.

Fourthly, the use of small ports in the injection tip to effectuate atomizing requires the addition of pressurized equipment to force the injection chemical through the small ports and into the fluid flow. It is desirable to eliminate the need for additional capital expenditure for the pressurizing equipment.

Existing devices which seek to address these concerns are typically simple devices made up of a hollow tube which is open on one end. The opposed end of the hollow tube has a process connection that allows the device to be threadably received into a threaded coupling on the pipeline. Oftentimes there may be a check or isolation valve at the entrance to the injector device. These injectors introduce a jet of liquid chemical into a process flow without regard to the dynamics of atomization droplet formation by the laterally flowing fluid flow stream. Once a jet of liquid is injected directly into a fluid stream, the ability of that stream to atomize the liquid depends on the physical properties of the fluid stream moving through this pipeline. If the liquid is not atomized, it will collect as a liquid on the interior walls of the pipeline. Because the chemical injected is often a very reactable caustic or acidic fluid, liquid chemical directly impinging on the pipeline walls may cause corrosion.

Past approaches to chemical injection include McClintock (U.S. Pat. No. 3,734,111) which discloses introducing a second fluid into a pipeline with a first fluid by a sparger pipe 2 perpendicular to the pipeline having a series of holes 3 which are perpendicular to the flow of fluid in the pipe section. McClintock's device requires substantial pipeline modification, cannot be easily relocated and causes substantial pressure loss in the pipeline.

Sewell et al. (U.S. Pat. No. 4,995,915) discloses a chemical injector with an injector quill of any conventional design. The injection quill 11 is capable of injecting the liquid in such a way to mix the fluids in a finely atomized or mist form. The present invention is an ideal application for Sewell's requirements.

Dela (U.S. Pat. No. 5,277,250) discloses a chemical injector quill with a lower end of the quill stem closed by a removable plug or cap. Three staggered rows of jet openings 46 are uniformly spaced along its length in order to disperse chemical. Dela reveals that the invention is for liquid service. Furthermore, the numerous holes are subject to fouling and required pressurizing equipment. Also the requirement for the device to extend across the entire pipeline diameter causes pressure drop.

Ziemer (U.S. Pat. No. 6,165,372 and 6,238,557) disclose a first quill and a second quill with the second quill end spaced from the first quill end. Outlet tip ends 52 and 64 for the outlets of the quills are beveled and have notches 92 and 94, respectively, formed at the extremities in order to increase turbulence in the liquid stream. The notch or notches were not provided to encourage atomization and dispersion of the injected liquid into the gaseous stream. Tests of this configuration in a gaseous stream reveal that the injected liquid stream flows off the end of the injector tip without any atomization occurring.

There remains a need to improve two-fluid atomization methods and equipment.

There remains a need to provide an improved chemical injector to more efficiently atomize injected fluid chemicals into a pipeline stream without allowing the injected fluid to build up on the interior walls of the pipeline.

There remains a need to provide an improved chemical injector using the force of fluid flow through the pipeline to advantageously disperse injected fluid chemicals.

There remains a need to provide a chemical injector that effectively atomizes the injected fluid without clogging the injection apparatus.

SUMMARY OF THE INVENTION

The present invention is directed to a chemical injector and a method or process for injecting a fluid chemical into a pipeline.

The present invention is used with a mechanism to pump a fluid chemical into a chemical injector and into a pipeline. The pumping pressure capacity of the chemical injection pump needs only to be slightly higher than the internal pipeline pressure. A chemical injection pump pumps fluid from a storage tank or other storage facility into and through a chemical delivery tube. The chemical delivery tube is connected to the chemical injector by a standard tube connector. The chemical injector is installed in and through an opening in the wall of the pipeline. A threaded coupling having internal threads is welded or otherwise affixed to the pipeline. The chemical injector includes a cylindrical injector tube which has an axis substantially perpendicular to the axis of the pipeline. A body of the chemical injector has internal threads to receive the delivery tube connector. The body also includes external threads that allow the body to be received in and secured to the threaded coupling.

In one embodiment, the body also includes a one way check valve having a conical spring and a ball to prevent any fluid from moving backwards out of the pipeline. The conical spring is of such design that it minimizes injection pressure while allowing unimpeded injection fluid flow. Thus, preventing fouling problems.

The injector tube terminates in an injector tube tip having an angled end. The longest end of the tube and the tip, thus, initially meets with fluid flowing through the pipeline. The angled end forms a straight line extending from the injector tube axis toward the downstream direction at an acute angle. In a preferred embodiment, the acute angle is approximately 30°.

The tube tip also includes an aperture through a wall of the tube tip. The aperture is circular and is opposed to the angled end of the tube tip. Fluid chemical passing out of the injector tube near the aperture would be dispersed and aspirated directly into the pipeline.

DETAILED DESCRIPTION OF THE PREFERRED EMBODIMENTS

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

Figure 1:
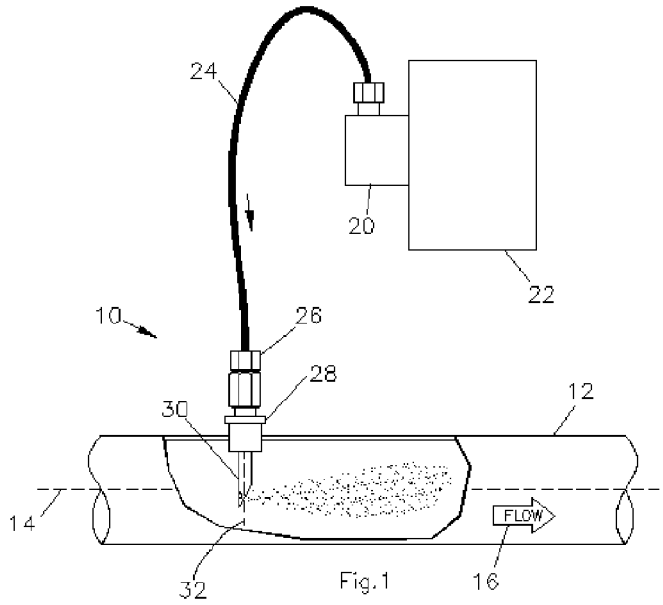
FIG. 1 illustrates a diagrammatic view of a chemical injector for injecting a fluid chemical into a pipeline as set forth in the present invention.

Referring to the drawings in detail, FIG. 1 illustrates a chemical injector 10 and the method or process for injecting a fluid chemical into a pipeline 12 having an axis 14 (shown by dashed lines).

The pipeline 12 has fluid flow from an upstream direction to a downstream direction so that fluid flow moves in a direction shown by arrow 16.

A mechanism to pump a fluid chemical into the chemical injector 10 and into the pipeline 12 includes a chemical injection pump 20 which pumps fluid from a storage tank or other storage facility 22 into and through a chemical delivery tube 24.

The chemical delivery tube 24 is connected to the chemical injector 10 via a standard tube connector 26.

The chemical injector 10 is installed through an opening in the wall of the pipeline 12. A threaded coupling 28 having internal threads is welded or otherwise fixed to the pipeline. The chemical injector 10 includes a cylindrical injector tube 30 which has an axis 32 substantially perpendicular to the axis 14 of the pipeline 12.

Figure 2:
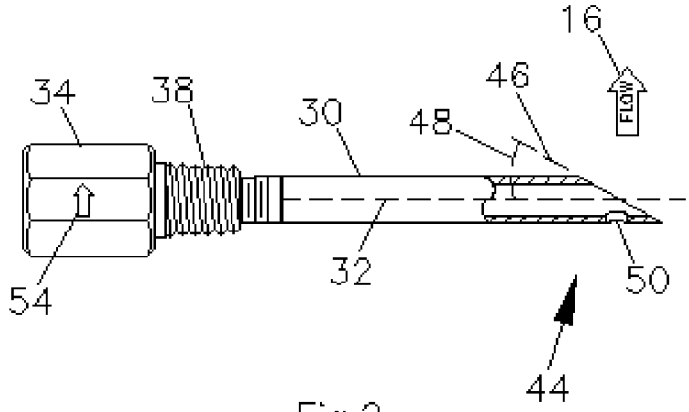
FIGS. 2 and 3 illustrate the chemical injector as shown in FIG. 1 with portions cut-away in each for clarity.
Figure 3:
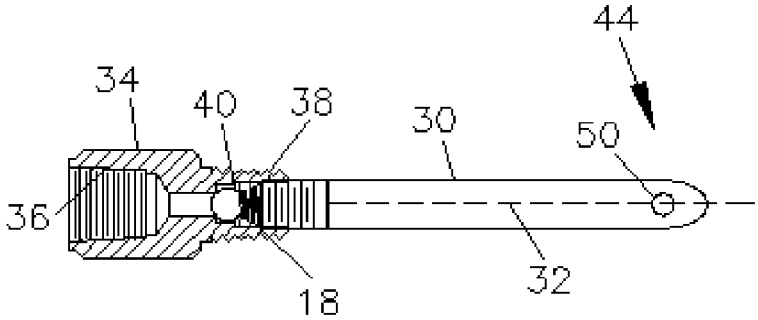

FIG. 2 illustrates a side view of the chemical injector 10 apart from the pipeline while FIG. 3 illustrates the chemical injector apart from the pipeline with another portion cut away for ease of viewing.

The injector tube axis 32 is visible in both FIGS. 2 and 3. A body 34 has internal threads 36 (best seen in FIG. 3) to receive the delivery tube connector 26 (not shown in FIGS. 2 and 3). The body 34 also includes external threads 38 that allow the body 34 to be received in and secured to the threaded coupling 28, extending through an opening of the pipeline 12.

The body 34 also includes internal threads 18 that allow the injector tube 30 to be sealed to the body 34. In an alternate embodiment (not shown), the tube 30 could be welded to the body 34.

The body 34 also includes a one-way check valve 40 having a spring and ball to prevent any fluid from moving backwards out of the pipeline. Accordingly, the check valve eliminates any backflow. It will be understood that the invention may be practiced with or without a spring.

The injector tube 30 terminates in an injector tube tip 44, having an angled end (best seen in FIGS. 1 and 2). The longest end of the tube and tip 44, thus, initially meets the fluid flowing through the pipeline 12. As best seen in FIG. 2, the angled end forms a straight line 46 (illustrated by dashed lines).

The angled end forms a line 46 extending from the injector tube axis 32 toward the downstream direction illustrated by arrows 16 and 54 at an acute angle 48, illustrated by dashed lines. In one preferred embodiment, the acute angle 48 is approximately 30°, although it will be appreciated that the acute angle may be varied within the teachings of the present invention.

The tube tip 44 also includes an aperture 50 through a wall of the tube tip. The aperture 50 is circular and is opposed to the angled end 46 of the tube tip. Fluid passing through the injector tube 30 will meet high velocity fluid in the pipeline 12 passing through the aperture 50 and will be dispersed and aspirated into said pipeline. The aperture 50 is located approximately one-third the diametrical distance from the wall of the pipeline 12. The injector tube tip 44 is located approximately one-third the diametrical distance from the wall of the pipeline 12.

Finally, the circular aperture 50 may be beveled or counter sunk slightly (not shown).

The chemical injector 10 may be fabricated from various materials. In a preferred embodiment, the injector is fabricated from stainless steel, although other materials are possible. The spring may be fabricated from a nickel-chrome alloy, and the ball may be fabricated from silicon nitride ceramic.

In order to utilize the present invention, a ball is placed into the body 34 and the spring is thereafter placed in the body with the smallest diameter end facing and mating with the ball. Thereafter, the injector tube 30 is screwed into the body 34 to seal the tube to the body. Thereafter, the assembled chemical injector 10 is inserted into the threaded coupling 28 which is mounted by welding or otherwise fixed to the pipeline 12. An arrow 54 may be stamped or printed on an external portion of the body 34 to indicate the orientation of the angled tip of the tube tip 44 inside of the pipeline 12. The chemical delivery tube 24 attached to the chemical injection pump 20 is connected to the body 34 of the injector via tube connector 26.

The effective dispersion of the fluid chemical in the pipeline minimizes the possibility of corrosive chemical build-up on the walls of the pipeline.

Whereas, the present invention has been described in relation to the drawings attached hereto, it should be understood that other and further modifications, apart from those shown or suggested herein, may be made within the spirit and scope of this invention.

What is claimed is:

1. A chemical injector for injecting a fluid chemical into a pipeline having an axis, said pipeline having fluid flow moving from an upstream to a downstream direction, said injector comprising:

an injector tube having an axis substantially perpendicular to said axis of said pipeline;

an injector tube tip having an angled end, wherein said angled end forms a line extending from said injector tube axis and toward said downstream direction at an acute angle;

an aperture through said tube tip of said injector tube; and means to pump said injected fluid through said injector tube and said tube tip into said pipeline.

2. A chemical injector as set forth in claim 1 wherein said aperture is circular.

3. A chemical injector as set forth in claim 1 wherein said aperture is located approximately one-third the diametrical distance from the pipeline wall.

4. A chemical injector as set forth in claim 1 wherein said injector tube tip is located one-third the diametrical distance from the wall of the said pipeline.

5. A chemical injector as set forth in claim 1 wherein said pipeline fluid flow is at a higher velocity than flow of fluid chemical through said injector tube.

6. A chemical injector as set forth in claim 1 wherein said acute angle is approximately 30 degrees (30°).

7. A chemical injector as set forth in claim 1 wherein said means to pump includes a pump in fluid communication with said injector tube.

8. A chemical injector as set forth in claim 1 including a spring loaded ball one way check valve.

9. A chemical injector as set forth in claim 1 including a body having external threads receivable in a threaded coupling through said pipeline.

10. A method to inject a fluid chemical into a pipeline having an axis, wherein said pipeline has fluid flow from an upstream direction to a downstream direction, said method comprising:

pumping said fluid chemical into an injector tube, wherein said injector tube has an axis substantially perpendicular to said axis of said pipeline;

pumping said fluid chemical from said injector tube through an injector tip having an angled end, wherein said angled end forms a line extending from said injector tube axis toward said downstream direction at an acute angle;

dispersing said fluid chemical passing from said tip into said pipeline with aspiration from fluid passing through an aperture in said angled end of tube.

11. A method to inject a fluid chemical as set forth in claim 10 wherein said aperture is circular.

12. A method to inject a fluid chemical as set forth in claim 10 including positioning said angled end near said axis of said pipeline.

13. A method to inject a fluid chemical as set forth in claim 10 wherein said acute angle is approximately thirty degrees (30°).

14. A method to inject a fluid chemical as set forth in claim 10 wherein said pipeline fluid flow is at a higher velocity than said pumping of said fluid chemical through said injector tip.

15. A chemical injector for injecting a fluid chemical into a pipeline having an axis, said pipeline having fluid flow moving from an upstream to a downstream direction, said injector comprising:

an injector tube having an axis substantially perpendicular to said axis of said pipeline;

an injector tube tip having an angled end, wherein said angled end forms a line extending from said injector tube axis and toward said downstream direction at an acute angle;

an aperture through said tube tip of said injector tube; and a spring loaded ball one way check valve.

* * * * *